US005584079A

United States Patent [19]

Wong et al.

[11] Patent Number: 5,584,079

[45] Date of Patent: Dec. 17, 1996

[54] PROGRAMMABLE DISPENSER

[76] Inventors: Sek M. G. Wong; Yin P. P. Lee, both of 25 Holland Hill #04-07, Holland Peak Condominium, Singapore, 1027

[21] Appl. No.: 509,545

[22] Filed: Jul. 31, 1995

[30] Foreign Application Priority Data

Aug. 1, 1994 [GB] United Kingdom ..... 9415520

[51] Int. Cl.[6] ..... E03D 9/03

[52] U.S. Cl. ..... 4/226.1

[58] Field of Search ..... 4/223, 224, 225.1, 4/226.1, 309

[56] References Cited

U.S. PATENT DOCUMENTS

| | | | |
|---|---|---|---|
| 1,447,289 | 3/1923 | Farnham | 4/226.1 |
| 3,445,865 | 5/1969 | Rumsey, Jr. | 4/309 |
| 5,513,394 | 5/1996 | Kodaira | 4/226.1 |

FOREIGN PATENT DOCUMENTS

| | | | |
|---|---|---|---|
| 0338825 | 10/1989 | European Pat. Off. | 4/226.1 |
| 0024258 | of 1896 | United Kingdom | 4/226.1 |
| 0221079 | 9/1924 | United Kingdom | 4/226.1 |

*Primary Examiner*—Robert M. Fetsuga
*Attorney, Agent, or Firm*—Lawrence Y. D. Ho

[57] ABSTRACT

The present invention is a programmable dispenser for dispensing the appropriate amount of cleansing agents during peak period and adequate amount of cleansing agents during off-peak period without compromising the overall bacteria kill rate. The dispenser features a microcontroller coupled to a solenoid valve for allowing users to program the dispensing of cleansing agents over a predetermined number of peak-hour intervals and at least one cut-off period. The dispenser of the present invention also incorporates a float subassembly within a bucket for receiving measured amounts of cleansing agents and accomplishing two important functions in response to the actual usage of urinal: (1) dosing the urinal upon demand when the urinal is flushed, and (2) dosing the urinal directly when the urinal is either not flushed or flushed infrequently. Dosing on demand is carried out when a portion of the flushed liquid from the flush pipe is diverted to the bucket over a connecting pipe and an elbow channel. A float compartment of the float subassembly topples the subassemby which is pivoted over a hinge in the bucket. The cleansing agents mix with the flush liquid before returning to the flush pipe. Direct dosing results from the overflow of cleansing agents from a tongue portion of the float subassembly through the elbow channel and connecting pipe into a discharge tube within the flush pipe. As such, a given supply of cleansing agents is guaranteed to meet the pattern of actual urinal usage without compromising the overall bacteria kill rate in urinals.

4 Claims, 5 Drawing Sheets

FIG. 1
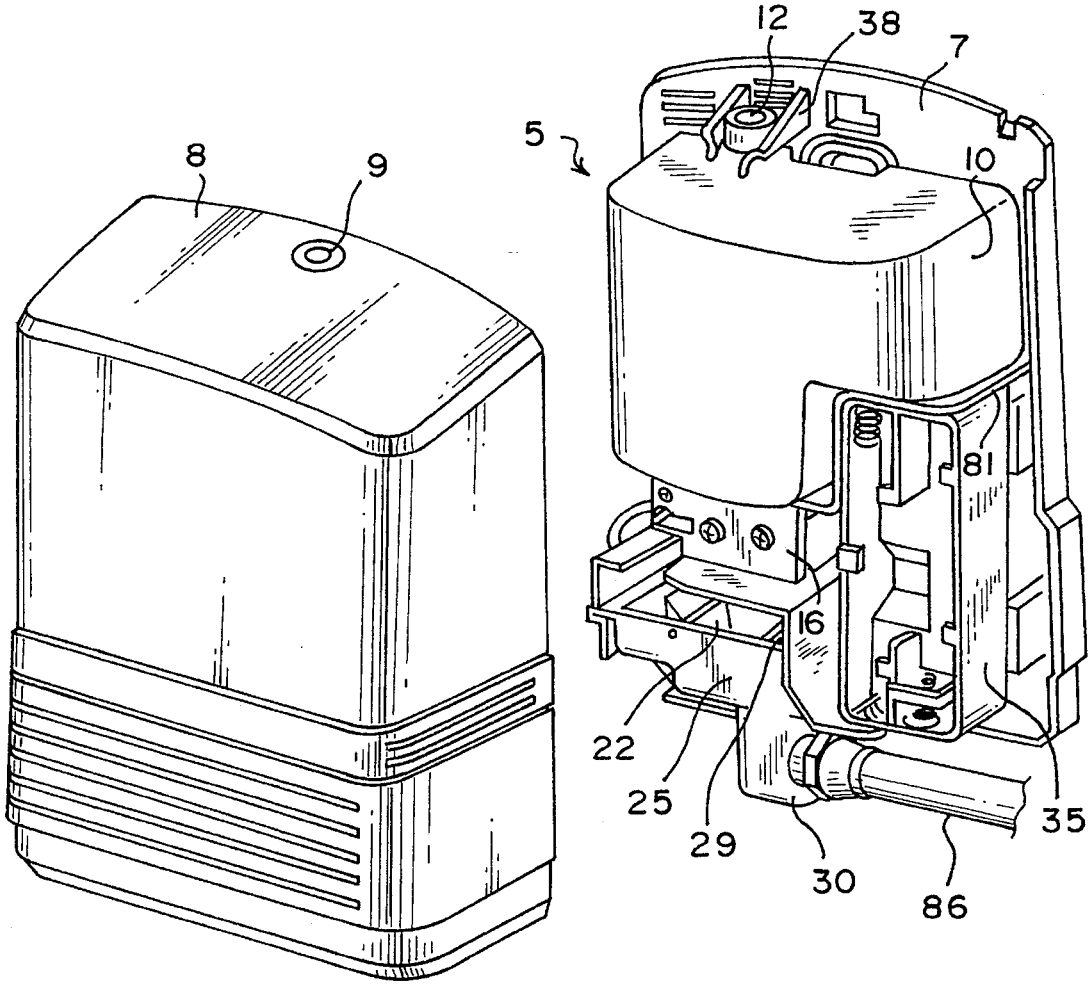
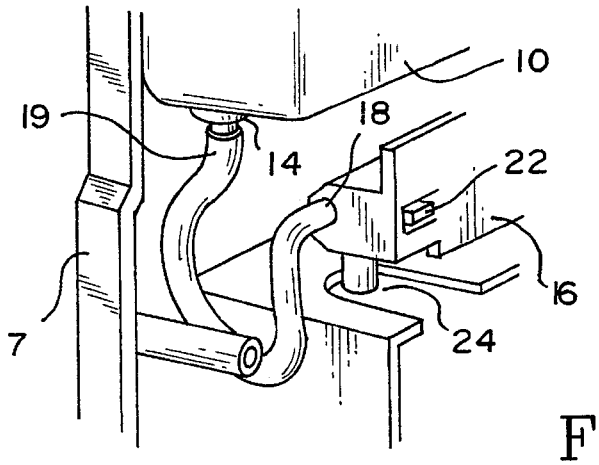
FIG. 2

PROGRAMMABLE DISPENSER

The present invention describes an apparatus and method of cleansing and deodorizing the toilet bowl, urinal and receptacle for collecting human discharge. In particular, the present invention pertains to the programmable and automatic dispensing of cleansing agents into the toilet and washroom areas.

It is well known in service and hotel/hospitality industry to keep its washroom areas hygienic by dispensing cleansing agents. Hitherto there are two methods for dispensing cleansing agents in toilet bowls and urinals: (1) continuous dosing and (2) dosing on demand (or flushing). By cleansing agents, the present invention refer to detergents, deodorants, disinfectants or a combination thereof. Furthermore, for ease of understanding, the present invention refers to toilet bowls, urinals, cisterns or other receptacles for receiving human discharge as urinals.

Continuous dosing delivers constant amount of cleansing agents directly to the urinals. One end of a wick draws cleansing agents from a liquid reservoir at the bottom of an inverted vaccum bottle. The cleansing agents on the other end of the wick is delivered by gravity and via a tube directly to the underside of the rim of urinal. The advantage of continuous dosing devices is that it is simple and relatively maintenence free. However, countinuous dosing is not activated by the flushing action of urinal and as such not responsive to the pattern of actual use of the urinal. It follows that large amounts of cleansing agents are required to cleanse and deodorize urinals over a service cycle. Therefore, continuous dosing devices are bulky and require frequent refill of cleansing agents. Dosing on demand (or flushing) devices dispense measured amounts of cleansing agent in response to the flusing action of the urinals. These devices are plumbed into the flush pipe through a connecting pipe. Flushing water enters a chamber via a valve therein and mixes with cleansing agents from an inverted bottle therein. The mixture is returned to the flush pipe together with the last portion of flushing water. The disadvantage of dosing on demand devices is that an inconsistent amount of cleansing agents is dispensed during peak period, and none when the urinal is not in use. It is well known that a minimum amount of cleansing agent is needed to maintain the hygiene of urinals in order to deter any growth of bacteria. Dosing on demand also exhausts cleansing agent before the end of a service cycle thus necessitating premature refill.

The present invention is a programmable dispenser for dispensing the appropriate amount of cleansing agents during peak period and adequate amount of cleansing agents during off-peak period without compromising the overall bacteria kill rate. The dispenser features a microcontroller coupled to a solenoid valve for allowing users to program the dispensing of cleansing agents over a predetermined number of peak-hour intervals and at least one cut-off period. The dispenser of the present invention also incorporates a float subassembly within a bucket for receiving measured amounts of cleansing agents and accomplishing two important functions in response to the actual usage of urinal: (1) dosing the urinal upon demand when the urinal is flushed, and (2) dosing the urinal directly when the urinal is either not flushed or flushed infrequently. Dosing on demand is carried out when a portion of the flushed liquid from the flush pipe is diverted to the bucket over a connecting pipe and an elbow channel. A float compartment of the float subassembly topples the subassemby which is pivoted over a hinge in the bucket. The cleansing agents mix with the flush liquid before returning to the flush pipe. Direct dosing results from the overflow of cleansing agents from a tongue portion of the float subassembly through the elbow channel and connecting pipe into a discharge tube within the flush pipe. As such, a given supply of cleansing agents is guaranteed to meet the pattern of actual urinal usage without compromising the overall bacteria kill rate in urinals.

FIG. 1 is a perspective, right side, elevational view of the programmable dispenser according to a preferred embodiment of the present invention.

FIG. 2 is a partial perspective, left side, elevational view of the valve housing of the programmable dispenser according to the present invention.

Figure 5:
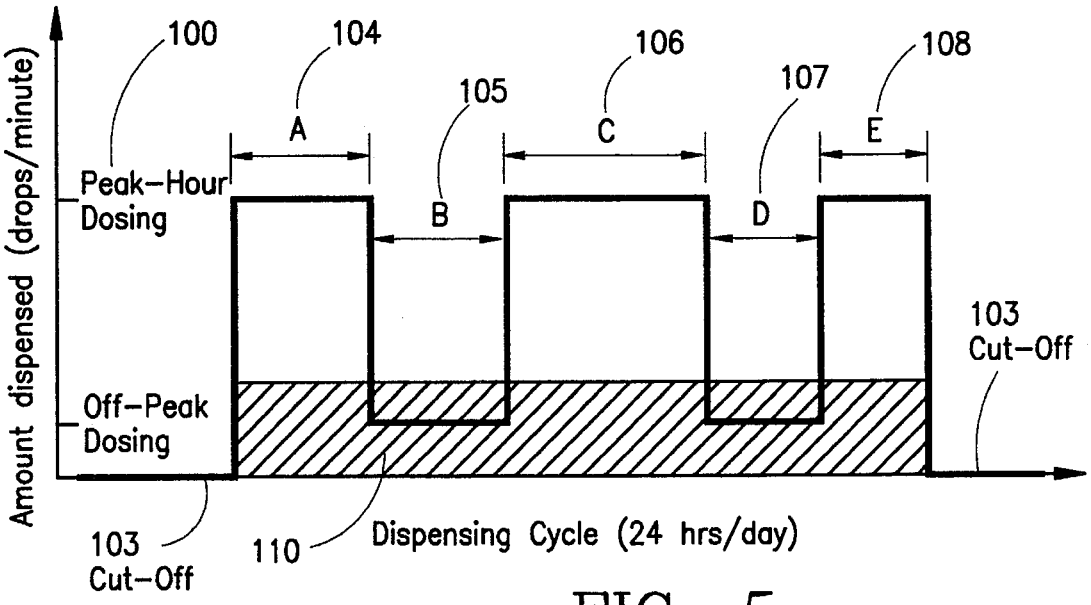

FIG. 5.is a chart illustrating the improved matching of the amounts of cleansing agent dispensed with the pattern of actual usage in a service cycle.

DETAILED DESCRIPTION OF THE INVENTION

A method and apparatus for dispensing cleansing agents effectively in a washroom environment is described. In the following description, numerous specific details are set forth such as reservoir and valve housing, etc. in order to provide a thorough understanding of the present invention. It will be obvious to one skilled in the art that the present invention may be practiced without these specific details. In other instances, well-known parts such as those involved with the toilet bowl and piping are not shown in order not to obscure the present invention.

FIG. 1 is a perspective, right side, elevational view of the programmable dispenser according to a preferred embodiment of the present invention. The dispenser 5 comprises a back plate 7, a front cover 8, a reservoir 10, a valve housing 16, a bucket 25, an elbow section 30 and a controller circuit 40 (not shown in FIGS. 1 and 2). The back plate 7 is for mounting the dispenser assembly onto to a flat and preferably vertical surface, while the front cover 8 cooperates with the back plate 7 to shield and protect the dispenser 5. A lock 9 is provided on the front cover to restrict access to the dispenser assembly therein. The reservoir 10 is a removable container for receiving and storing cleansing agents such as detergents, deodorants, wetting agents, and/or disinfectants. The reservoir has two opening—a top cap 12 and a bottom nozzle 14 (shown in FIG. 2) for filling and dispensing the cleansing agents respectively. The reservoir 10 is mounted onto the back plate 7 by placing it on top of a support plate 81 and additional anchoring provided by the mounting neck 38 onto the top cap 12. The bottom nozzle 14 is connected to the valve housing 16. Referring to FIG. 1, the valve housing 16 comprises a housing having a valve nozzle 18 for receiving a hose 19 from the reservoir 10 and a discharge nozzle 24 for dispensing measured amounts of cleansing agents. The valve housing 16 further contains a solenoid 20 (not shown in FIGS. 1 and 2) and a plunger 22. The function of the solenoid 20 shall be elaborated in the description of the control circuit 40 in FIG. 3 below. The plunger 22 is connected to the solenoid 20 and is used to open or shut the orifice of the valve housing which allows the dosing of cleansing agent to be performed. The plunger 22 also acts as a lever for priming the programmable dispenser manually. The plunger is used when one wishes to replace or replenish the reservoir. Below the valve housing 16 is the bucket for pre-mixing the dispensed cleansing agents and flushing liquids. The structure and functions of the bucket and elbow assembly shall be elaborated below in connection with the description of FIGS. 4A–4C.

In FIG. 1, a power compartment 35 is provided for providing DC power to the control circuit 40. The control circuit 40 is located behind the power compartment 35 so that the circuit is shielded from the moisture from the bucket 25.

FIG. 2 is a partial perspective, left side, elevational view of the valve housing of the programmable dispenser according to the present invention. The hose 19 connects the bottom nozzle 14 of the reservoir 10 to the valve nozzle 18 of the valve housing. The plunger 22 is again shown clearly in FIG. 2. As mentioned above, the function of the plunger is to prime the system by removing air bubbles in the discharge nozzle after the user replenishes the reservoir. The discharge nozzle 24 of the valve housing is pointed directly into the bucket 25 (not shown in FIG. 2) for dispensing measured amounts of cleansing agents therein.

Figure 3:
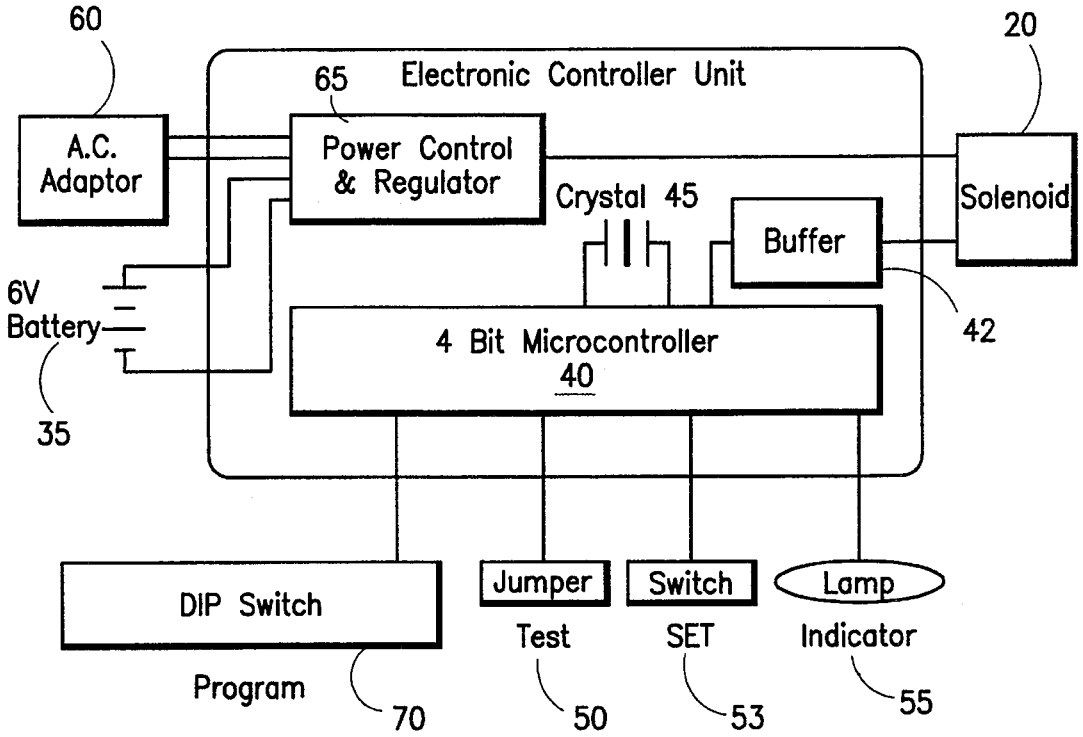
FIG. 3 show a schematic of the controller circuit of the programmable dispenser according to the present invention.

FIG. 3 shows a schematic of the controller circuit of the programmable dispenser according to the present invention. The circuit 40 is coupled to the solenoid 20 in the valve housing 16 for controlling precisely the amounts of cleansing agent dispensed. The circuit is also coupled to the power source over the power compartment 35. Not shown in any of the figures but should be understood by one skilled in the art, the control circuit 40 is coupled to an on-line power source 60 over a power control and regulator 65. The control circuit 40 is preferably a microcontroller which is powered either by the on-line power source or the power source. The microcontroller has at least a SET switch 53 and a DIP switch 70 for allowing users to program a predetermined number of peak-hour periods, and at least one cut-off period. The microcontroller also features a test switch 50 for testing the integrity of the controller circuit 40. The status of the controller circuit is also indicated by a LED 55. The various switches are used for activating and de-activating the various modes of the microprocessors.

In FIG. 3 the microcontroller 40 controls the dispensing of cleansing agents by activating the solenoid 20 over the amplifier 42 in response to the programmed setting in DIP switch 70. The amplifier 42 has a transistor which amplifies the signals from the microcontroller 40 to the required level to drive the solenoid 20 in the valve housing. The microcontroller is provided with a clock 45 for generating the real time clock signals and for determining the appropriate time for dispensing the cleansing agents at the programmed intervals. In the preferred embodiment of the present invention, the microcontroller is a μPD17136A. It should be understood by one skilled in the art that other suitable microcontroller may be used to control the dispensing of cleansing agents. The microcontroller has at least three modes of operations: (1) Programming mode—it allows users to program five blocks of peak-hour and off-peak times, a cut-off time and real-time clock before performing the actual timer operation; (2) Run mode—it starts the timer operation; and (3) Test mode—it tests the functionality of the microcontroller unit.

With the microcontroller 40 controlling the dispensing the cleansing agents from the reservoir 10 into the bucket 25, the dispenser 5 of the present invention provides improved performance over prior art dispensers. The dispensing is not only based on actual usage, but the amount dispensed on each flushing is also controlled. As such, the present invention reduces wastage. Furthermore, the entire operation is controlled by a microcontroller and hence fully automated. The programmable feature allows the user to tailor the usage and dosage to a full range of usages. Thus the dispenser of the present invention is also versatile.

FIG, 4A is a cross sectional, right side elevational view of the bucket and elbow section assembly of the present invention before the flushing action commences. The assembly comprises the bucket 25, the elbow section 30, and a connecting pipe 86. The connecting pipe 86 is coupled to a flushing pipe 88 (not shown in FIG. 1) via an opening 90. The bucket 25 further comprises a float subassembly 27 which is pivoted within the bucket around a hinge 75. The float subassembly 27 further comprises a hollow float compartment 78, a tongue portion 80 and rod/stopper subassembly 82. The float compartment 78 provides bouyancy to the float subassembly 27 when the bucket is filled with liquid. The tongue portion 80 receives and stores controlled amounts of cleansing agent 26 from the discharge nozzle 24 (not shown in FIGS. 4A–4C). The float subassembly serves two important functions in response to the actual usage of urinal: (1) dosing the urinal upon demand when the urinal is flushed, and (2) dosing the urinal directly when the urinal is either not flushed or flushed infrequently. Dosing on demand is carried out when a portion of the flushed liquid from the flush pipe 88 is diverted to the bucket over the connecting pipe 86 and the elbow channel 30. The float compartment 78 of the float subassembly topples the subassemby 27 which is pivoted over the hinge 75 in the bucket. The cleansing agents mix with the flush liquid before returning to the flush pipe 88 (described in FIG. 4 B). Direct dosing results from the overflow of cleansing agents from the tongue portion 80 of the float subassembly 27 through the elbow channel 30 and connecting pipe 86 into the discharge tube 98 within the flush pipe. Hence, direct dosing occurs when the interval between each successive flushings is sufficiently long to permit the amounts of cleansing agents 26 in the tongue portion 80 to overflow. It follows that the amount of cleansing agents dispensed is determined automatically by the actual number of flushes over a time period. If the number of acutal flushes is large, the amount of cleansing agent for direct dosing is less. Similarly, if the number of actual flushes is small, the amount of cleansing agent for direct dosing is more.

Figure 4A:
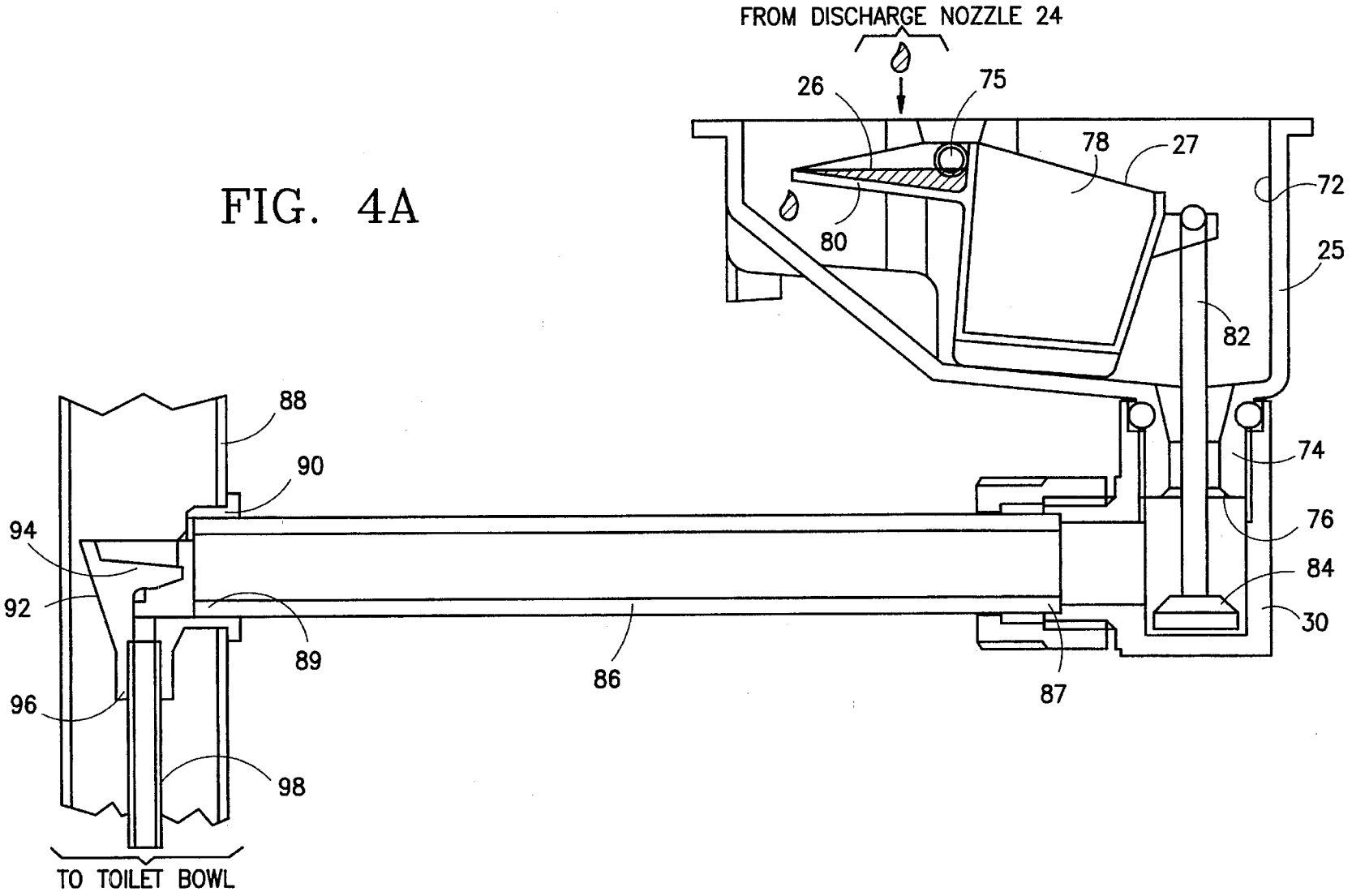
FIG. 4A is a cross sectional, right side elevational view of the bucket and elbow section assembly of the present invention before the flushing action commences.

The interior volume of the bucket 25 communicates with that of the elbow section 30 over the bucket outlet 74. The bucket outlet has an internal outlet profile 76 which fits snuggly with the stopper 84 when the rod/stopper subassembly is raised to the fullest extent. One end 87 of the connecting pipe 86 is coupled to the elbow section 30, while the other end 89 is coupled to the flushing pipe 88. An elbow channel 92 disposed within the flushing pipe 88 for directing the flushing liquids to and forth the bucket 25. As shown in FIG. 4A, the elbow channel 92 is also coupled to a discharge tube 98 within the flushing pipe 88 for directing the overflow of cleansing agent directly into the urinal. Although, the elbow channel and the discharge tube are disposed within the flushing pipe in FIGS. 4A–4C, it should be understood by one skilled in the art that they may also be connected external to the flushing pipe. For example, one end of a smaller pipe enclosing the discharge tube may be connected to discharge nozzle 24 of valve housing 16 and the other end to the urinal. It should be noted that the dosing on demand feature is unavailable once the discharge tube is connected outside of the flushing pipe.

Figure 4B:
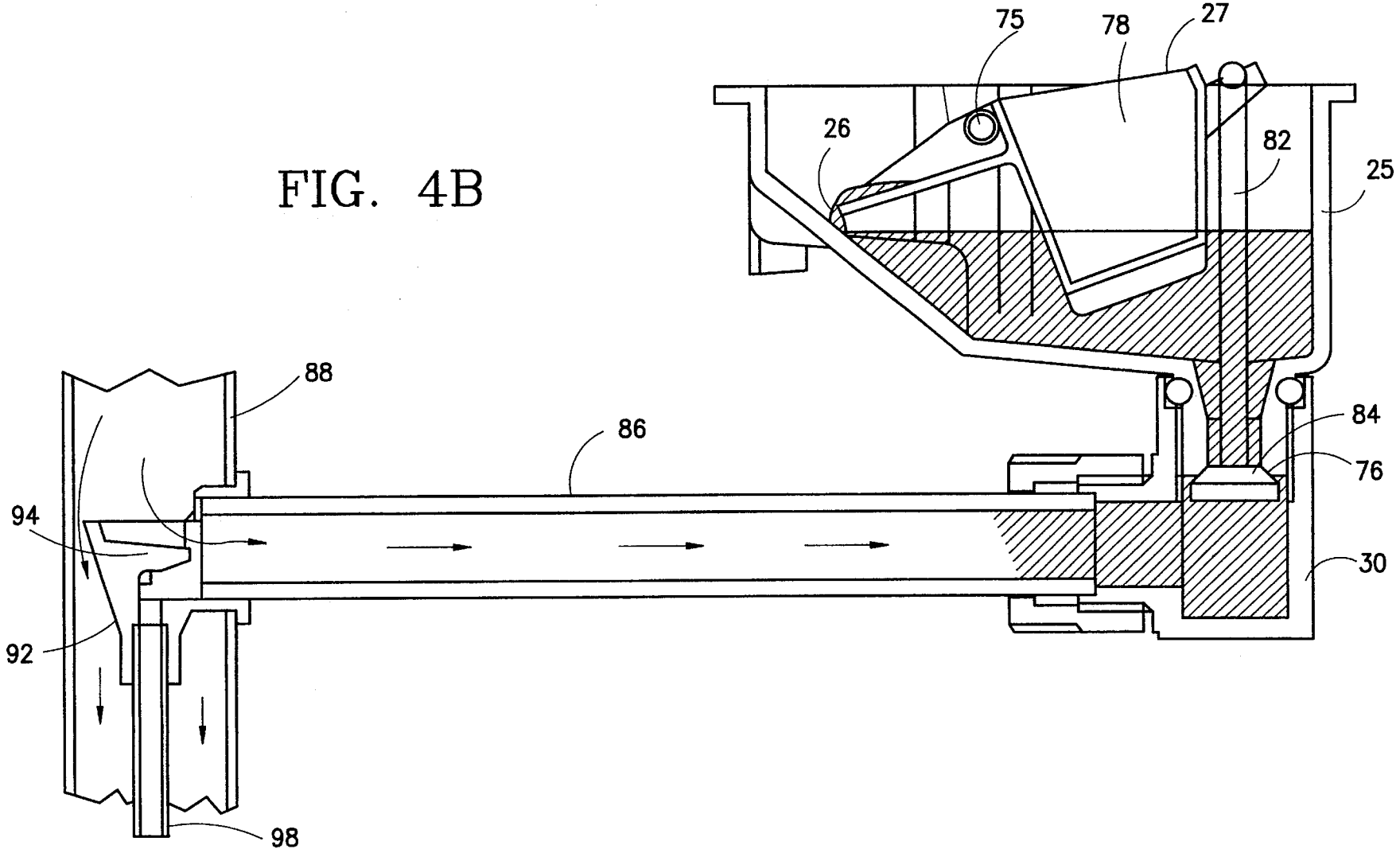
FIG. 4B is a cross sectional, right side elevational view of the bucket and elbow section assembly of the present invention while the flushing action takes place.

FIG. 4B is a cross sectional, right side elevational view of the bucket and elbow section assembly of the present invention while the flushing action takes place. When the flushing action begins, a portion of the flushing liquid shall be redirected into the connecting pipe 86 by an elbow tongue 94 of the elbow channel. The elbow 30 and the bucket 25 are also filled with flushing liquid. At an appropriate level, the float assembly gains buoyancy and raises the rod/stopper subassembly. The stopper 84 prevents an overflow of the flushing liquids in the bucket as it comes into contact with the outlet profile of the bucket outlet. At the same time, cleansing agents 26 disposed on the tongue portion of the float assembly flow out of the the tongue portion 80 as the float assembly 27 is tilted as shown in FIG. 4B. The cleansing agents 26 mix with the flushing liquid. It is evident that the bucket and elbow assebly in FIGS. 4 permits the premixing of the cleansing agents and the flushing liquid before they are discharged into the toilet bowl.

Figure 4C:
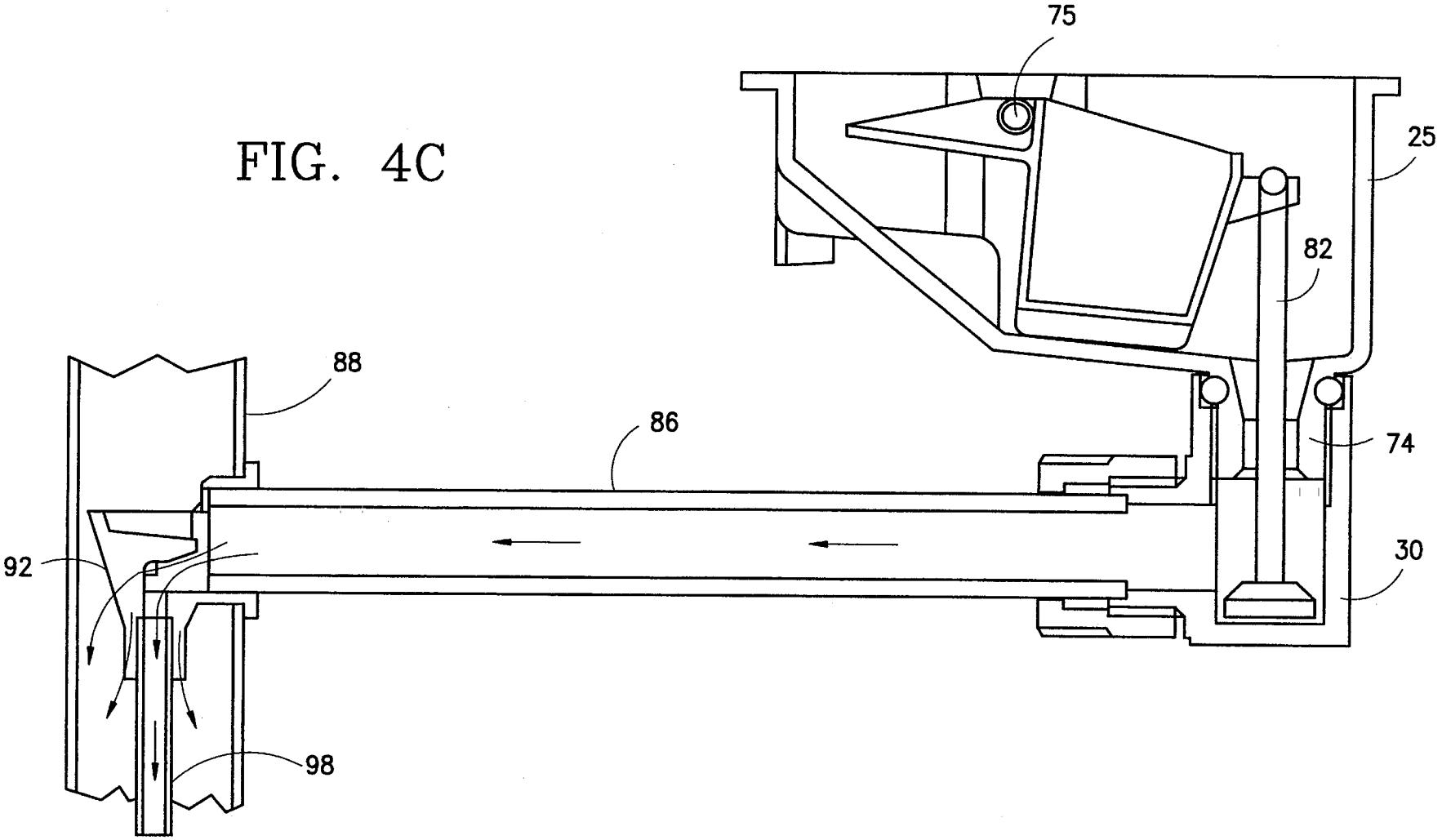
FIG. 4C is a cross sectional, right side elevational view of the bucket and elbow section assembly of the present invention after the flushing action takes place.

FIG. 4C is a cross sectional, right side elevational view of the bucket and elbow section assembly of the present invention after the flushing action takes place. The arrows in FIG. 4C shows the path the cleansing agents mixture as it is discharged from the bucket to the toilet bowl over the connecting pipe 86, the elbow channel 92, flush pipe 88, and the discharge tube 98. In the preferred embodiment of the present invention, the discharge tube runs from the elbow channel 92 through the flush pipe 88 to the flush opening (not shown) located on the underside of the top rim of the toilet bowl. This construction enables the cleansing agents to be discharged directly into the water in the toilet bowl for cleansing the contaminated areas therein.

FIG. 5 is a chart illustrating the improved matching of the amounts of cleansing agents dispensed with the pattern of actual usage in a service cycle. On the vertical axis is the rate at which the cleansing agent is dispensed. On the horizontal axis is the service or dispensing cycle. The choice of programmable intervals on the controller circuit is as follows:

| | |
|---|---|
| A) Cut-off time | No dosing at all; optional step; illustrated by interval 103 in FIG. 5. |
| B) Off-peak time | Intervals which do not fall under peak-hour times and cut-off time; illustrated by intervals 105 and 107 in FIG. 5. |
| C) Peak-hour time | Intervals having the most amount of dosing; usually correspond to the heavy usage of toilet; maximum 5 blocks of such intervals; illustrated by intervals 104, 106 and 108 respectively in FIG. 5. |

The peak-hour dosing 100 represents the number of dosing available during the peak-hour intervals such as intervals 104, 106 and 108. On the other hand, off-peak dosing 101 corresponds to number of dosing allocated during the off-peak intervals such as 105 and 107 in FIG. 5. The relationship of the peak-hour dosing 100 and the off-peak dosing 101 is as follows:

$$\text{Peak-hour dosing} = \text{one day dosing} - \text{off-peak dosing}, \quad (1)$$

where one day dosing is the number of dosing for one service cycle or one day.

In the prefered embodiment of the present invention, the one day dosing is either 75 or 100 drops of cleansing agent per day. It should be understood by one skilled in the art that the one day dosing may be changed to suit new circumstances. Furthermore, the dosing interval at peak-hour time is related as follows:

$$\text{Dosing Interval at Peak-hour} = \frac{\text{Total peak hour time}}{\text{Peak-hour dosing}} \quad (2)$$

Three peak hour times 104, 106 and 108 are shown in FIG. 5 and another two off-peak times 105 and 107 illustrate a possible combination of five possible peak-hour and off-peak times in which the controller 40 can be programmed. It should be understood by one skilled in the art that the number of peak-hour and off-peak times and at least one cutoff time is particular to the specific microcontroller chosen for the preferred embodiment and should not be taken as a limitation on the present invention. The cross-etched area 110 in FIG. 5 represents the total amount of cleansing agent which is required for a service or dispensing cycle. In other words, this amount is the maximum amount which will be required to meet the kill rate of bacteria. While users approximate the average pattern of urinal usage by programming the controller in accordance to equations (1) and (2), the float assembly in the bucket of the present invention allocates cleansing agents judiciously between direct dosing and dosing on demand in response to the actual usage of the urinals. As such, a given supply of cleansing agents is guaranteed to meet the pattern of actual urinal usage without compromising the overall bacteria kill rate in urinals.

While the present invention has been described particularly with reference to FIGS. 1 to 5 with emphasis on a method and apparatus to dispense cleansing agents effectively in a washroom environment, it should be understood that the figures are for illustration only and should not be taken a limitation on the invention. In addition, it is clear that the method and apparatus of the present invention has utility in many applications where controlled and measured dispensing of liquids or chemicals is required. It is contemplated that many changes and modifications may be made by one of ordinary skill in the art without departing from the spirit and the scope of the invention as described.

I claim:

1. In a system for dispensing cleansing agents automatically, said system comprising:

a controller circuit for controlling a valve coupled to a reservior of cleansing agents, said controller circuit releasing controlled amounts of cleansing agents in response to a programmed pattern of usage;

a conduit for coupling to a flushing pipe for diverting partially liquid therefrom;

a bucket for receiving cleansing agents from said valve and for pre-mixing said agents with liquid from said conduit, said bucket having an opening at a bottom for receiving liquid from said conduit, said bucket further having a float assembly pivoted internally for controlling the amount of liquid flowing therein, said float assembly further having a tongue portion and a float compartment for allocating cleansing agents between direct dosing and dosing on demand;

whereby a given supply of cleansing agents is dispensed to meet the pattern of actual urinal usage.

2. The dispensing system as in claim 1 wherein said controller circuit comprising a solenoid.

3. The dispensing system as in claim 1 wherein said conduit further having an elbow channel at the end closer to the flushing pipe for diverting flushing liquid into said bucket at the beginning of a flushing action and directing a mixture of cleansing agents and liquid away from said bucket at the end of the flushing action.

4. The dispensing system as in claim 3 wherein said elbow channel is coupled to a discharge tube positionable in the flushing pipe for directing a mixture of cleansing agents and liquid directly into the urinal.

* * * * *